US011607879B2

(12) United States Patent
Ueda

(10) Patent No.: US 11,607,879 B2
(45) Date of Patent: Mar. 21, 2023

(54) CAP DEVICE AND LIQUID EJECTION APPARATUS

(71) Applicant: Brother Kogyo Kabushiki Kaisha, Aichi-Ken (JP)

(72) Inventor: Toshiro Ueda, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 17 days.

(21) Appl. No.: 17/203,358

(22) Filed: Mar. 16, 2021

(65) Prior Publication Data

US 2021/0300018 A1 Sep. 30, 2021

(30) Foreign Application Priority Data

Mar. 24, 2020 (JP) ..... JP2020-052161

(51) Int. Cl.
*B41J 2/045* (2006.01)
*B41J 2/165* (2006.01)

(52) U.S. Cl.
CPC ..... *B41J 2/0451* (2013.01); *B41J 2/0458* (2013.01); *B41J 2/04581* (2013.01); *B41J 2/16505* (2013.01)

(58) Field of Classification Search
CPC ..... B41J 2/0451; B41J 2/16505
See application file for complete search history.

(56) References Cited

U.S. PATENT DOCUMENTS 7,673,956 B2 * 3/2010 Izuo ..... B41J 2/16579 347/14
7,753,468 B2 7/2010 Endo et al.
8,033,649 B2 * 10/2011 Endo ..... B41J 11/02 347/31
2007/0134969 A1 6/2007 Endo et al.
2010/0238230 A1 9/2010 Endo et al.
2017/0232747 A1 8/2017 Nishida

FOREIGN PATENT DOCUMENTS

JP 2007-176152 A 7/2007
JP 2008-168524 A 7/2008
JP 2013-188969 A 9/2013
JP 2017-144727 A 8/2017

* cited by examiner

*Primary Examiner* — Sharon Polk
(74) *Attorney, Agent, or Firm* — Banner & Witcoff, Ltd.

(57) ABSTRACT

A cap device includes a cap, an accommodation member, and a cover. The cap covers a nozzle surface of a liquid ejection head. The accommodation member is accommodated in the cap and is fixed to the cap. The accommodation member has a conductivity and receives a voltage that generates a potential difference between the liquid ejection head and the accommodation member. The accommodation member includes a first portion and a second portion connected with each other. The cover covers the second portion of the accommodation member, and has a surface that is co-planar with a surface of the first portion. The cover has a conductivity and receives a voltage that generates a potential difference between the liquid ejection head and the cover.

17 Claims, 9 Drawing Sheets

CAP DEVICE AND LIQUID EJECTION APPARATUS

CROSS-REFERENCE TO RELATED APPLICATION

This application claims priority from Japanese Patent Application No. 2020-052161 filed on Mar. 24, 2020, the content of which is incorporated herein by reference in its entirety.

TECHNICAL FIELD

The present invention relates to a cap device including a cap that covers a nozzle surface having a plurality of nozzles and an accommodation member having a conductivity, and a liquid ejection apparatus including the cap device.

BACKGROUND

A known device accommodates an ink absorption member and an electrode having a mesh structure in a box member (i.e., a cap). The device determines an ejection condition by ejecting an ink from a nozzle of a print head toward the electrode.

The device has a support rod integrally formed on the bottom surface. The support rod passes through each of the ink absorption member and the electrode, and a head of the support rod is swaged by being heated and pressurized. Thus, each of the ink absorption member and the electrode is fixed to the box member.

SUMMARY

One or more aspects of the disclosure provide a technology that enhances an accuracy of inspection of the ejection condition.

In one or more aspects of the disclosure, a cap device may include a cap, an accommodation member, and a cover. The cap may be configured to cover a nozzle surface of a liquid ejection head. The nozzle surface may include a plurality of nozzles each ejecting a droplet of liquid therefrom. The accommodation member may be accommodated in the cap. The accommodation member may have a conductivity, and may be configured to receive a voltage that generates a potential difference between the liquid ejection head and the accommodation member. The accommodation member may include a first portion and a second portion connected with each other. The accommodation member may be fixed to the cap. The cover may be configured to cover the second portion of the accommodation member. The cover may have a surface that is co-planar with a surface of the first portion. The cover may have a conductivity and may be configured to receive a voltage that generates a potential difference between the liquid ejection head and the cover.

DETAILED DESCRIPTION

Figure 1:
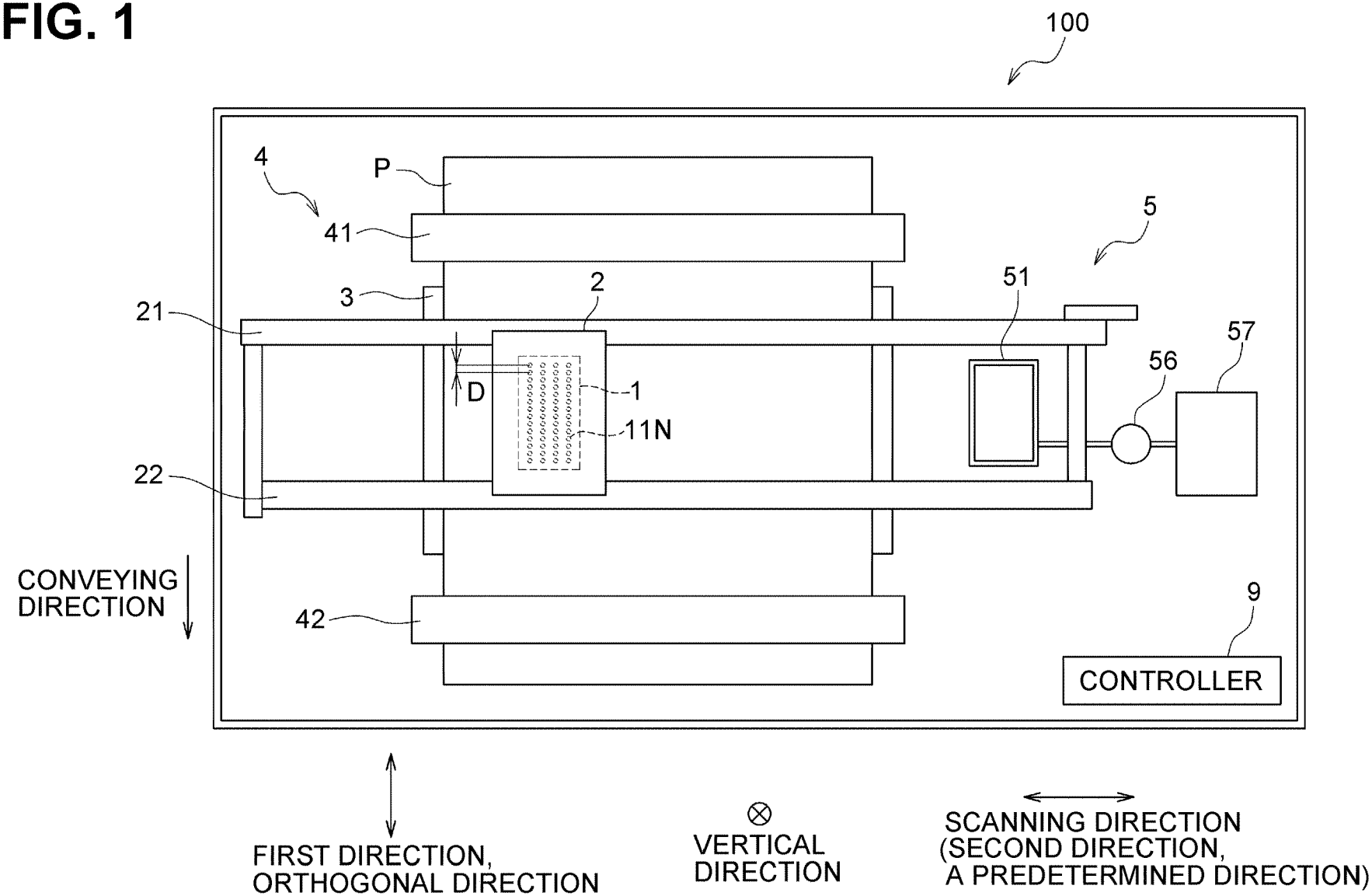
FIG. 1 is a plan view of a printer according to an illustrative embodiment of the disclosure.

As illustrated in FIG. 1, a printer 100 includes a head 1, a carriage 2, a platen 3, a conveying mechanism 4, a maintenance unit 5 including a cap device 51, and a controller 9. The printer 100 may be an example of a "liquid ejection device". The head 1 may be an example of a "liquid ejection head".

Figure 2:
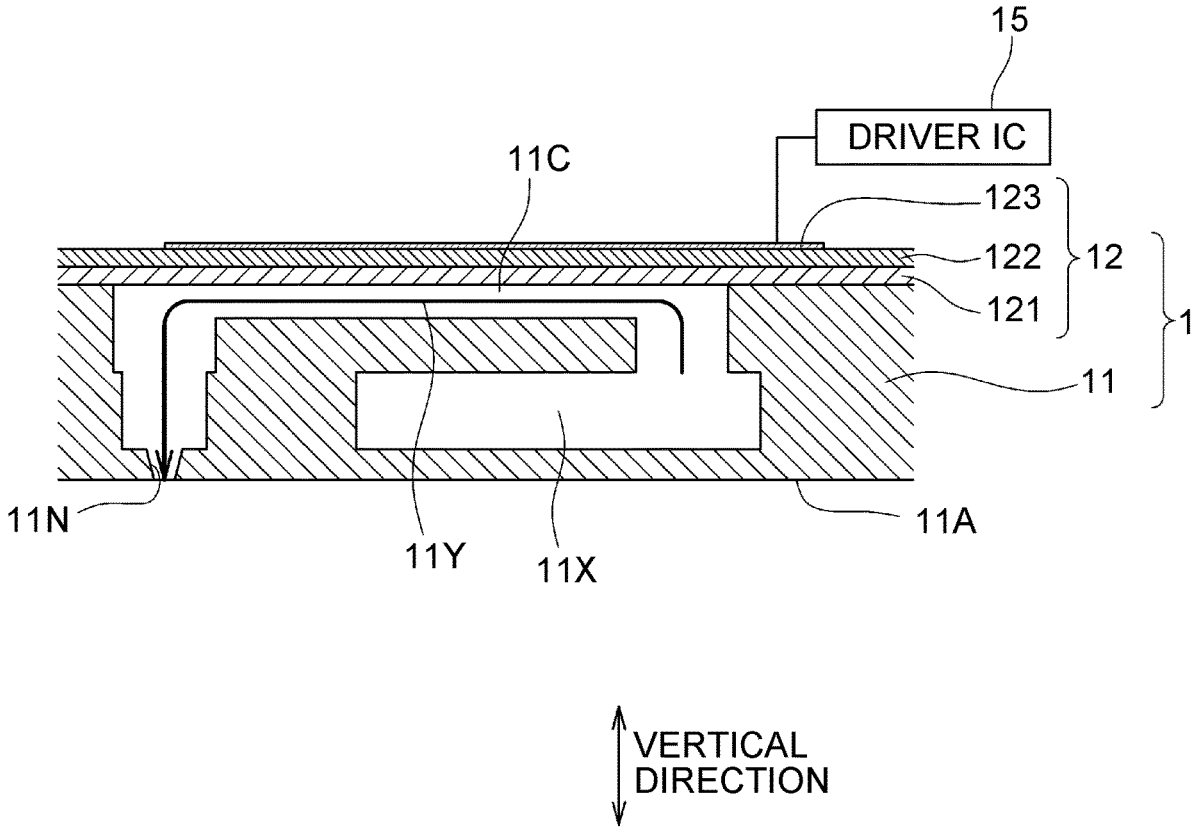
FIG. 2 is a cross-sectional view of a head in the printer.

As illustrated in FIG. 2, the head 1 includes a channel unit 11 and an actuator unit 12. A lower surface of the channel unit 11 includes a nozzle surface 11A including a plurality of nozzles 11N. The lower surface of the channel unit 11 extends orthogonal to a vertical direction. An internal area of the channel unit 11 includes a common channel 11X and a plurality of individual channels 11Y. The common channel 11X communicates with an ink tank (not shown in figures). Each of the plurality of individual channels 11Y communicates between the common channel 11X and a corresponding nozzle 11N. The channel unit 11 has a plurality of pressure chambers 11C each included in a corresponding individual channel 11Y. Each of the plurality of pressure chambers 11C has an opening at an upper surface of the channel unit 11. The actuator unit 12 includes a vibrating plate 121, a piezoelectric layer 122, and a plurality of individual electrodes 123. The vibrating plate 121 is disposed above the upper surface of the channel unit 11 for covering the plurality of pressure chambers 11C. The piezoelectric layer 122 is disposed above the vibrating plate 121. The plurality of individual electrodes 123 are disposed above the piezoelectric layer 122 each facing a corresponding pressure chamber 11C. Each of the individual electrodes 123 and the pressure chambers 11*c* sandwiches the vibrating plate 121 and the piezoelectric layer 122. Each sandwiched portion performs as an individual unimorph type actuator for a corresponding pressure chamber 11C, and is independently deformable.

As illustrated in FIG. 1, the carriage 2 is configured to support a head 1. The carriage 2 is supported by a pair of guide rails 21 and 22 extending in a scanning direction parallel to the nozzle surface 11A. The carriage 2 moves in the scanning direction along the pair of guide rails 21 and 22. Thus, the head 1 may be located at least one of a maintenance position or a non-maintenance position. At the maintenance position, the head 1 faces the cap device 51 in the vertical direction. At the non-maintenance position, the head 1 does not face the cap device 51 in the vertical direction.

The platen 3 is disposed below the head 1 and the carriage 2. The platen 3 includes an upper surface for supporting a sheet P. The sheet P may be an example of a "recording medium".

The conveying mechanism 4 includes a pair of rollers 41 and a pair of rollers 42. The platen 3 is disposed between the pair of rollers 41 and the pair of rollers 42 in a conveying direction. The conveying direction is parallel to the nozzle surface 11A, and orthogonal to the scanning direction. The pair of rollers 41 and the pair of rollers 42 are configured to hold the sheet P.

The maintenance unit 5 includes the cap device 51, an absorption pump 56 and a waste-fluid tank 57. The cap device 51 is disposed adjacent to one end of the platen 3 in the scanning direction.

Figure 3:
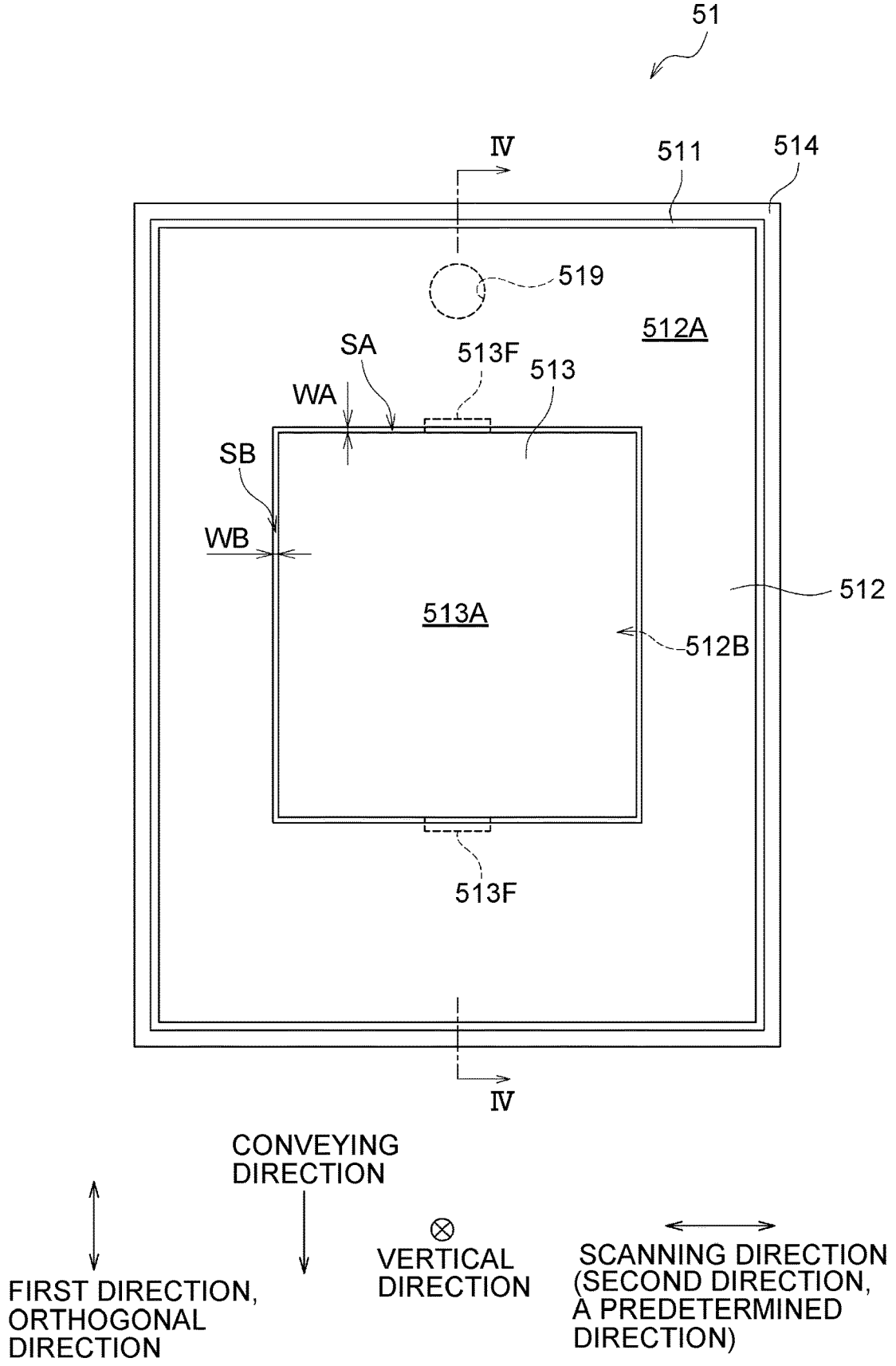
FIG. 3 is a plan view of a cap device in the printer.
Figure 4:
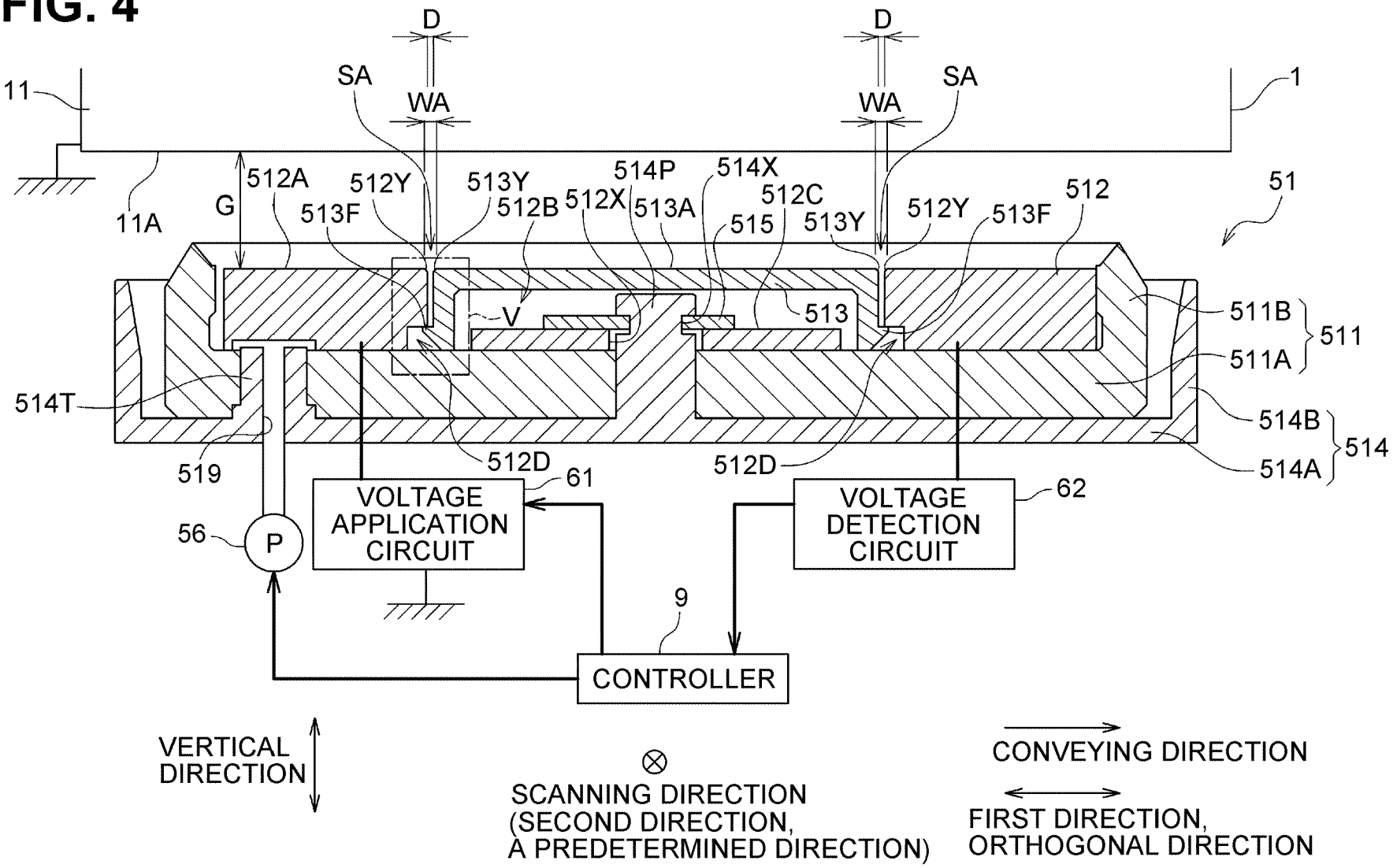
FIG. 4 is a sectional view taken along line IV-IV of FIG. 3.

As illustrated in FIGS. 3 and 4, the cap device 51 includes a cap 511, an accommodation member 512, a cover 513, and a cap holder 514. The accommodation member 512 is accommodated in the cap 511. At a center of the accommodation member 512 is a concave portion 512B. The cover 513 is fit for the concave portion 512B. The cap holder 514 is configured to support the cap 511.

Each of the accommodation member 512 and the cover 513 is conductive, and performs as an electrode for inspection. In this embodiment, each of the accommodation member 512 and the cover 513 is made of a conductive resin, such as polyacetal blended with carbon powder. A conductivity of the accommodation member 512 may be identical to a conductivity of the cover 513.

The cap 511 and the cap holder 514 are non-conductive. In this embodiment, the cap 511 is made of an elastic material such as rubber, and the cap holder 514 is made of a non-conductive synthetic resin.

As illustrated in FIG. 4, the cap holder 514 has a lower portion 514A extending orthogonal to the vertical direction, and a side portion 514B protruding upward from the lower portion 514A. The cap 511 is disposed at a rectangle space defined by the lower portion 514A and the side portion 514B.

The cap 511 has a lower portion 511A extending orthogonal to the vertical direction, and a side portion 511B protruding upward from the lower portion 511A. The accommodation member 512 is disposed at a rectangle space defined by the lower portion 511A and the side portion 511B. The accommodation member 512 has a high stiffness than the cap 511 such that the side portion 511B keeps standing.

The accommodation member 512 has a surface 512A located at a periphery of the concave portion 512B, and a surface 512C that is a lower surface of the concave portion 512B. The surface 512C is an example of a "bottom of the concave portion 512B". Each of the surface 512A and the surface 512C faces upward, and faces the nozzle surface 11A when the head 1 is positioned at the maintenance position. The surface 512A is located above the surface 512C. A distance between the nozzle surface 11A and the surface 512A in the vertical direction is less than a distance between the nozzle surface 11A and the surface 512C in the vertical direction.

The cap holder 514 further includes a convex portion 514P and a tube portion 514T.

The convex portion 514P protrudes upward from a center portion of the lower portion 514A in each of the conveying direction and the scanning direction, and passes through each of the lower portion 511A and the accommodation member 512. The convex portion 514P passes through the accommodation member 512 such that the convex portion 514P protrudes from the surface 512C of the accommodation member 512. A tip of the convex portion 514P is disposed at the concave portion 512B. Adjacent to the tip of the convex portion 514P has a groove 514X. Fitting a retaining ring 515 in the groove 514X causes the accommodation member 512 to be fixed to the cap 511, and also causes the cap 511 and the accommodation member 512 to be fixed to the cap holder 514. A combination of the convex portion 514*p* and the retaining ring 515 may be an example of a "fixing unit".

The retaining ring 515 is non-conductive, and is made of a synthetic resin.

The tube portion 514T is disposed adjacent to a center of the lower surface 514A in the scanning direction and upstream in the conveying direction, and passes through the lower portion 511A of the cap 511. The tube portion 514T has discharging outlet 519 extending in the vertical direction. The discharging outlet 519 communicates with the absorption pump 56 via a tube so ink stored in the cap 511 is discharged through the discharging outlet 519. The discharging outlet 519 is covered by the accommodation member 512.

The cover 513 covers the convex portion 514P, and has a surface 513A that is co-planar with the surface 512A of the accommodation member 512. In this embodiment, the surface 513A of the cover 513 is at a same height with the surface 512A of the accommodation member 512 in the vertical direction. In other words, a distance between the nozzle surface 11A and the surface 512A is identical to a distance between the nozzle surface 11A and the surface 513A in a case where the head 1 is at the maintenance position.

The accommodation member 512 includes a pair of cavities 512D that communicate with the concave portion 512B in a case that the cover 513 is detached. The cover 513, when attached, separates the pair of cavities 512D from the concave portion 512B. When viewed from an upper side of the concave portion 512B as illustrated in FIG. 3, the pair of cavities 512D extends outward from the concave portion 512B, and toward a direction parallel to the conveying direction, which is a first direction, from a corresponding side that is along the scanning direction.

As illustrated in FIG. 3, the cover 513 has a first length in the first direction and a second length in a second direction parallel to the scanning direction, orthogonal to the first direction, and along the surface 512C. The second length is less than the first length. Each end of the cover 513 in the first direction includes a hook 513F as illustrated in FIGS. 3 and 4. The cover 513 is fixed to the accommodation member 512 as the hook 513F separates a portion defining the pair of cavities 512D in the accommodation member 512 from the concave portion 512B.

As illustrated in FIG. 3, each opening SA and SB is disposed between the accommodation member 512 and the cover 513. The opening SA extends in the second direction (i.e., a predetermined direction) along an edge of the surface 513A. The opening SB extends in the first direction (i.e., an orthogonal direction) along an edge of the surface 513A. That is, each opening SA and SB is disposed along an edge of the surface 513A. The periphery of the surface 513A is surrounded by openings SA and SB.

A width WA of the opening SA in the first direction is more than a center-to-center distance D between two nozzles 11N adjacent to each other as illustrated in FIG. 1. A width WB of the opening SB in the second direction is identical to the width WA of the opening SA. For example, each width WA and WA is approximately 0.15 mm, and the center-to-center distance D between the two nozzles 11N is approximately 0.08 mm. The center-to-center distance D may be a distance between two nozzles 11N adjacent to each other when viewed from the first direction, or may be a distance between two nozzles 11N adjacent to each other when viewed from the second direction.

As illustrated in FIG. 4, the accommodation member 512 has an inclined surface 512Y along the opening SA. The cover 513 has an inclined surface 513Y along the opening SA. The inclined surface 512Y is continuous with the surface 512A. The inclined surface 513Y is continuous with the surface 513A. The inclined surfaces 512Y and 513Y are angled outwardly away from the center of the opening SA. As such, the width between the inclined surfaces 512Y and 513Y increases as the inclined surfaces 512Y and 513Y respectively approach the surfaces 512A and 513A. The opening SB also has inclined surfaces (not shown) oriented in the same manner as the inclined surfaces 512Y and 513Y of the opening SA.

The hook 513F has a portion that overlaps the opening SA in the vertical direction and defines a bottom of the opening SA. The hook 513F is not located over the discharging outlet 519.

Because the accommodation member 512 contacts the cover 513 and both are conductive, the accommodation member 512 is electrically connected with the cover 513. The accommodation member 512 and the cover 513 are electrically connected with a voltage application circuit 61 and a voltage detection circuit 62. The voltage application circuit 61 is an example of a "voltage application member" and the voltage detection circuit 62 is an example of a "voltage detection member".

The voltage application circuit 61 is configured to apply a particular voltage VA to the accommodation member 512 and the cover 513 in accordance with control of the controller 9. The channel unit 11 in the head 1 is conductive and may be made of a metal, and is at a ground potential. Thus, a potential difference may be generated between the head 1 and the accommodation member 512, and between the head 1 and the cover 513. The potential difference between the head 1 and the accommodation member 512 may be substantially identical to the potential difference between the head 1 and the cover 513.

The voltage detection circuit 62 is configured to output to the controller 9 a signal indicating the potential difference between the head 1 and the accommodation member 512, and the potential difference between the head 1 and the cover 513.

Figure 6:
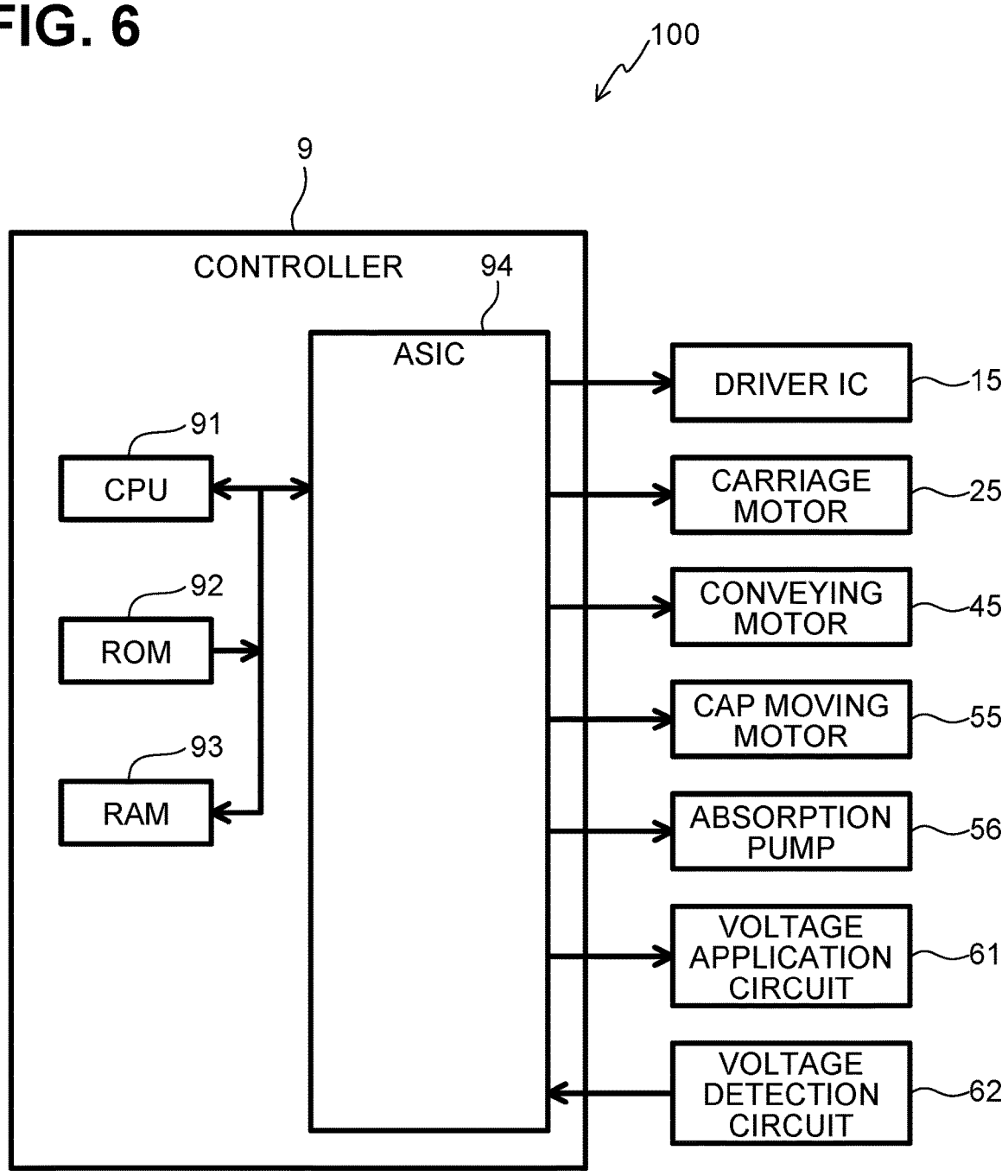
FIG. 6 is block diagram illustrating an electrical configuration of the printer.

As shown in FIG. 6, the controller 9 includes a CPU 91, a ROM 92, a RAM 93, and an ASIC 94 that includes various control circuits. The controller 9 is configured to communicate electrically with an external device such as a computer.

The ROM 92 stores programs and data for controlling various processes. The RAM 93 temporarily stores data with which the CPU 91 executes the program. In response to that the CPU 91 receives instructions from the external device, the CPU 91 instructs the ASIC 94, in accordance with the program and the data stored in the ROM 92 and RAM 93, to execute various processes.

The ASIC 94 is electrically connected to a driver IC 15, a carriage motor 25, a conveying motor 45, a cap moving motor 55, the absorption pump 56, the voltage application circuit 61, and the voltage detection circuit 62.

In a recording process, the ASIC 94 drives the driver IC 15, the carriage motor 25, and the conveying motor 45 in accordance with instruction from the CPU 91. The carriage motor 25 causes the pair of rollers 41 and the pair of rollers 42 to rotate while holding the sheet P, thereby the sheet P is conveyed in the conveying direction. The carriage motor 25 causes the carriage 2 to move in the scanning direction along the pair of guide rails 21 and 22. The driver IC 15 applies a voltage to each individual electrode 123. In accordance with the application of voltage, the actuator unit 12 deforms inward of a corresponding pressure chamber 11C, a capacity of the pressure chamber 11C decreases and a certain pressure is applied to ink in the pressure chamber 11C. Thus, a droplet of ink is ejected from the nozzle 11N. According to the conveying operation and the discharging operation being repeated alternately, an image with ink is formed on the sheet P.

In a maintenance process, in accordance with instruction of CPU 91, the ASIC 94 drives the carriage motor 25 to cause the head 1 to be located at the maintenance position, and drives the cap moving motor 55 to cause the cap device 51 to move upward in the vertical direction. Thus, an upper end of the side portion 511*b* of the cap 511 contacts the nozzle surface 11A so the cap 511 covers the nozzle surface 11A.

Driving the absorption pump 56 while the cap 511 covers the nozzle surface 11A generates a negative pressure that forces ink to be discharged from the nozzles 11N, whereby the discharged ink arrives at the cap device 511, i.e., the surface 512A of the accommodation member 512 and the surface 513A of the cover 513. The discharged ink may also enter the openings SA and SB. Driving the absorption pump 56 may be referred to as an absorbing purge.

Figure 5:
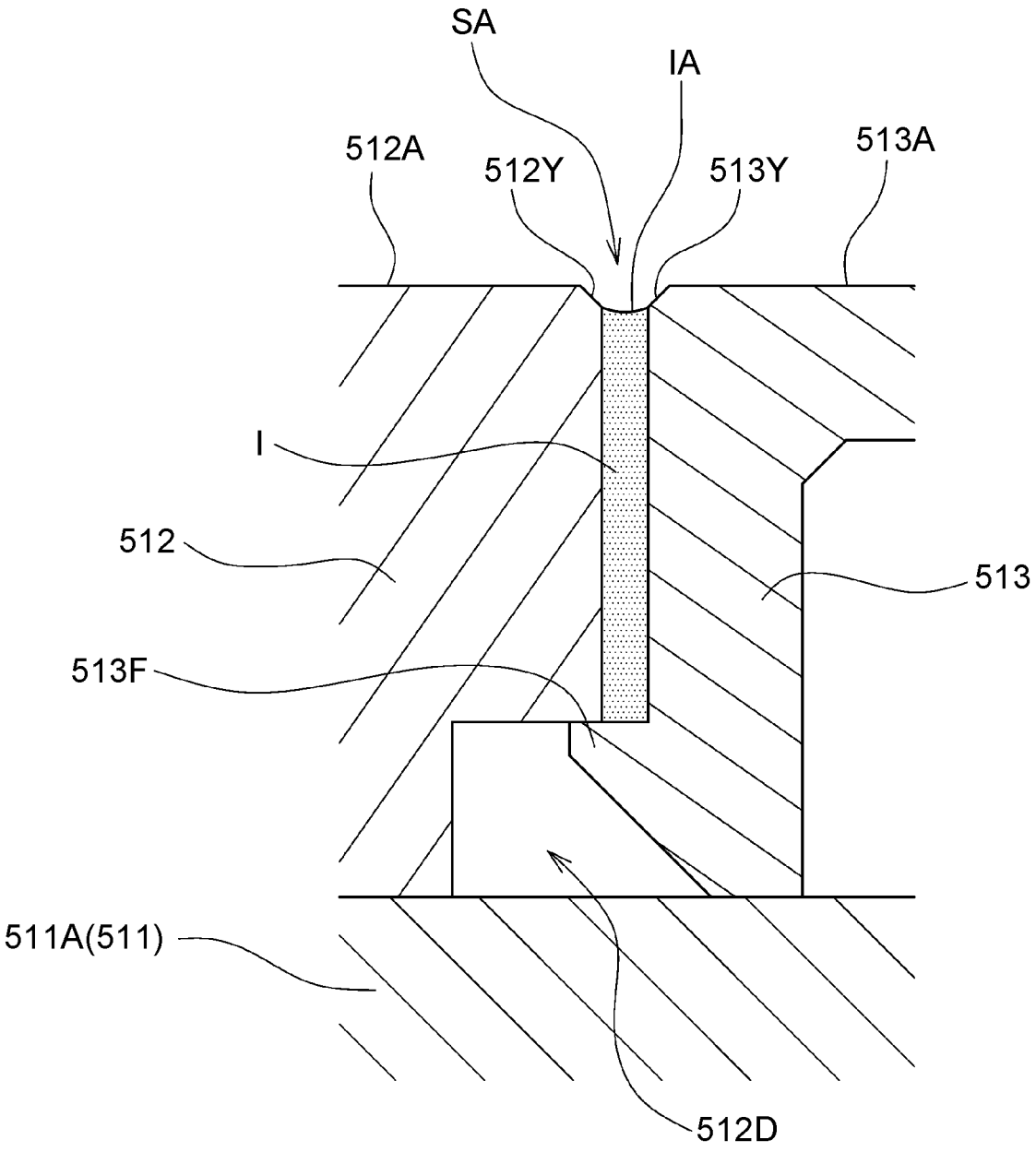
FIG. 5 is an enlarged view of a region V enclosed by a dashed line.

As illustrated in FIG. 5, ink I in the opening SA is held due to the hook 513F. A surface IA of the ink I is located below the surface 512*a* and the surface 513A due to a capillary phenomenon.

The ink which arrives at the cap 511 may flow through grooves or holes disposed at a side surface and a lower surface of the accommodation member 512, and may reach the discharging outlet 519. The ink may further flow through the absorption pump 56 to the waste-fluid tank 57 as shown in FIG. 1. The ink I in the opening SA may still remain as illustrated in FIG. 5.

For inspecting a nozzle clogging, in accordance with instructions by the CPU 91, the ASIC 94 drives the carriage motor 25 to cause the head 1 to be located at the maintenance position, and drives the driver IC 15 to cause the nozzles 11N to eject ink toward the accommodation member 512 and the cover 513. Inspecting a nozzle clogging is an example of an "inspecting discharging state of nozzle".

Figure 7A:
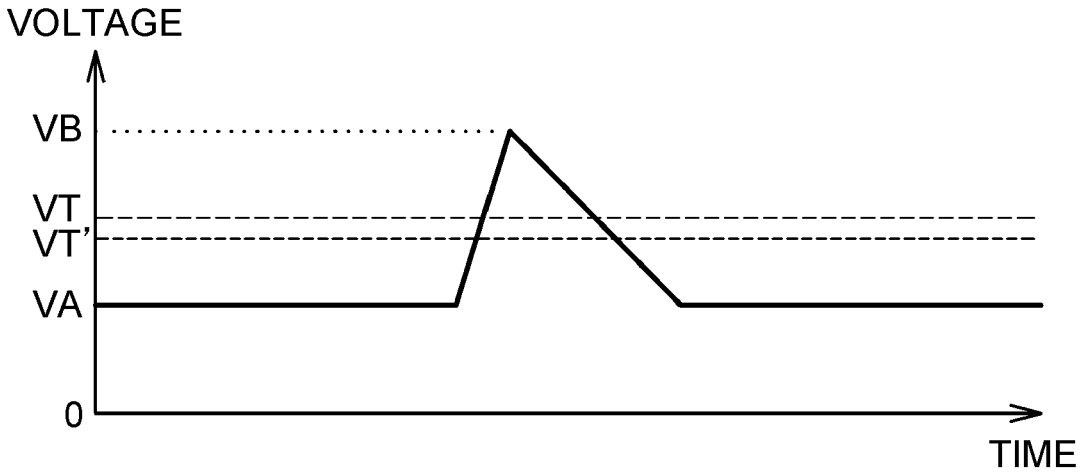
FIG. 7A is a diagram illustrating changes in voltage of an accommodating member and a cover in response to ejecting ink from a nozzle.
Figure 7B:
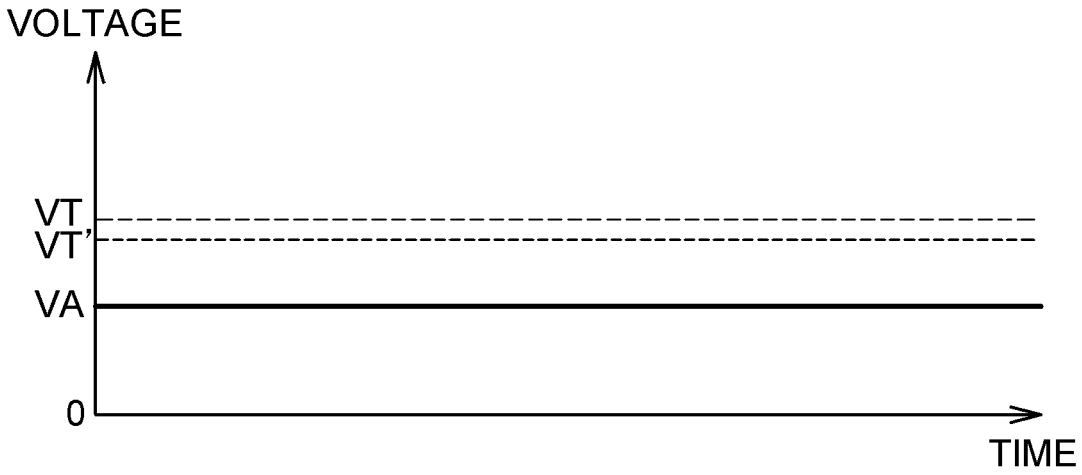
FIG. 7B is a diagram illustrating changes in voltage of the accommodating member and the cover without ejecting ink from the nozzle.

In this embodiment, each of the accommodation member 512 and the cover 513 has a function as an electrode for inspection. The voltage application circuit 61 is configured to apply a positive voltage VA to each of the accommodation member 512 and the cover 513. The ink is positively charged before being ejected. As illustrated in FIG. 7A, the voltage of each of the accommodation member 512 and the cover 513 increases as the ejected ink approaches the accommodation member 512 and the cover 513. The increasing voltage reaches a voltage VB greater than the voltage VA when the ink reaches the accommodation member 512 and the cover 513. The voltage gradually decreases after the ink reaches the accommodation member 512 and the cover 513 to the voltage VA. As illustrated in FIG. 7B, the voltage of each of the accommodation member 512 and the cover 513 is almost constant at the voltage VA while ink is not ejected from the nozzles 11N.

The ink I in the opening SA also functions as an electrode for inspection. The ink I in the opening SA is also positively charged at the voltage VA applied by the voltage application circuit 61 as the accommodation member 512 and the cover 513 are charged. Thus, the voltage of the ink I in the opening SA may change similarly as the voltage of the accommodation member 512 and the cover 513 change, as the ink is ejected from the nozzle 11N toward the opening SA.

The ROM 92 stores the threshold values VT and VT' for each nozzle 11N. Each of the threshold values VT and VT' is greater than the voltage VA, and less than the voltage VB. The threshold value VT' is used for inspecting particular nozzles 11N through which ink is ejected toward the opening SA. The threshold value VT is used for inspecting other nozzles 11N through which ink is ejected toward the surface 512A of the accommodation member 512 and the surface 513A of the cover 513. The threshold value VT is greater than the threshold value VT'.

The particular nozzles may be a plurality of nozzles 11N determined in consideration of manufacturing accuracy, such as backlash of the head 1 or the cap device 51. Thus, the plurality of nozzles 11N may be determined in a manner such that the plurality of nozzles 11N possibly face the opening SA in the vertical direction when the head 1 is at the maintenance position.

The voltage detection circuit 62 outputs a signal indicating the voltage of the accommodation member 512 and the cover 513 each time ink is ejected from each nozzle 11N. The ASIC 94 inspects the nozzle clogging in accordance with the output signal. The threshold vales VT and VT' are used for the inspection. The ASIC 94 determines that the nozzle 11N is not clogged (i.e., the ejecting condition of the nozzle 11N is normal) if the voltage of the accommodation member 512 and the cover 513 exceeds the threshold values VT or VT'.

The ASIC 94 performs various processing in accordance with the inspection result. For example, the ASIC 94 may execute the absorbing purge or a flashing if one or more nozzles 11N is determined to be clogged. The absorbing purge is a process of driving the absorption pump 56 for discharging ink from the nozzles 11N forcibly. The flashing is a process of driving the driver IC 15 to apply a voltage to the individual electrode 123 for discharging ink from the clogged nozzles 11N. On the other hand, the ASIC 94 may execute a regular printing process without executing the absorbing purge or the flashing if no nozzles 11N are determined to be clogged.

According to this embodiment, as illustrated in FIG. 4, the cover 513 having conductivity is disposed. The cover 513 covers the convex portion 514P and has a surface 513P that is co-planar with the surface 512A of the accommodation member 512 that faces the nozzle surface 11A. The surface 512A is at a same height with the surface 513A in the vertical direction. In the inspection of the ejection condition, ink ejected from the nozzles 11N reaches the surface 512A of the accommodation member 512 and the surface 513A of the cover 513. The ejection condition may be inspected based on the voltage of each of the accommodation member 512 and the cover 513 that performs as an electrode of inspection. Thus, an accuracy of inspection of the ejection condition may be enhanced.

As illustrated in FIGS. 3 and 4, the cover 513 is fit for the concave portion 512B. The ejection condition may be inspected by ejecting ink toward each of the surface 513A of the cover 513 and the surface 512A located at a periphery of the concave portion 512B.

As illustrated in FIGS. 3 and 4, the openings SA and SB are located between the accommodation member 512 and the cover 513. This configuration enables easy setting of the cover 513. As illustrated in FIG. 5, the ink in the opening SA may perform as an electrode for inspection. The ink enables drying of the nozzles 11N that are covered with the cap 511 to be avoided.

As illustrated in FIG. 4, the width WA of the opening SA is greater than the center-to-center distance D of the nozzles 11N. This configuration enables one or more nozzles 11N to face the opening SA during the inspection. In response to ejecting ink from certain nozzles 11N toward the opening SA, the ink in the opening SA may perform as an electrode of inspection.

As illustrated in FIGS. 4 and 5, the surface 512A of the accommodation member 512 has the inclined surface 512Y, and the surface 513A of the cover 513 has the inclined surface 513Y. As described previously, the inclined surfaces 512Y and 513Y are angled outwardly and away from each other relative to the center of the opening Sa. Without the inclined surfaces 512Y and 513Y, the height of the surface IA of the ink I in the opening SA may be unstable. For example, the height of the surface IA may be lower than the height of the surface 512A of the accommodation member 512 or the height of the surface 513A of the cover 513 as illustrated in FIG. 5. The height of the surface IA may also be higher than the height of the surface 512A of the accommodation member 512 or the height of the surface 513A of the cover 513. According to this embodiment, the inclined surfaces 512Y and 513Y causes the height of the surface IA of the ink I in the opening SA to be lower than the height of the surface 512A of the accommodation member 512 and the height of the surface 513A of the cover 513. Thus, the ink I in the opening SA may perform as an electrode for inspection that enables a stable inspection.

Either of the inclined surfaces 512Y and 513Y may be omitted. Either of the inclined surfaces 512Y and 513Y may cause the same effect as caused by both of the inclined surfaces 512Y and 513Y.

As illustrated in FIGS. 4 and 5, the hook 513F of the cover 513 overlaps the opening SA in the vertical direction, and includes a part defining a bottom of the opening SA. The hook 513F performs as a receiver of ink, which enables ink to be held in the opening SA.

The cover 513 has a first length in the first direction and a second length less than the first length in the second direction. The cover 513 may be easily transformed by a force applied in the first direction rather than a force applied in the second direction. As illustrated in FIG. 3, the hook 513F is located at the end of the cover 513 in the first direction. This configuration enables easy setting of the cover 513.

As illustrated in FIGS. 3 and 4, the hook 513F is not located over the discharging outlet 519. Due to this configuration, an absorbing force generated in the cap 511 through the discharging outlet 519 does not focus on the hook 513F. Thus, the absorbing force for ink I that is held due to the hook 513F may be suppressed.

As illustrated in FIG. 4, the accommodation member 512 includes a conductive resin, and covers the discharging outlet 519. Due to this configuration, the accommodation member 512 performs as a resistance against the absorbing force when the absorbing force is generated in the cap 511 through the discharging outlet 519. Thus, the absorbing force for the discharging outlet 519 may be suppressed. In other words, the absorbing force may be distributed throughout the cap 511. Thus, absorption of ink from the nozzles 11N may be performed throughout the cap 511 uniformly.

As illustrated in FIG. 4, the accommodation member 512 and the cover 513 are electrically connected to the voltage application circuit 61. Thus, the inspection may be performed by applying the particular voltage VA (shown in FIGS. 7A and 7B) to the accommodation member 512 and the cover 513.

The distance between the surface 512A of the accommodation member 512 and the nozzle surface 11A is identical to the distance between the surface 513A of the cover 513 and the nozzle surface 11A in a case where each of the surfaces 512A and 513A faces the nozzle surface 11A. Each of the distances is indicated as "G" in FIG. 4. This configuration may enhance the accuracy of inspection.

ASIC 94 determines that the nozzle 11N is not clogged (i.e., the ejecting condition of the nozzle 11N is normal) if the voltage of the accommodation member 512 and the cover 513 exceed threshold values VT or VT'.

As illustrated in FIGS. 7A and 7B, the threshold value VT' is for particular nozzles 11N that eject ink toward the opening SA. The threshold value VT is for nozzles other than the particular nozzles 11N and greater than the threshold value VT'. The ink I in the opening SA performs as an electrode for inspection similarly as the accommodation member 512 and the cover 513 perform as an electrode for inspection. The surface IA of the ink I in the opening SA is located below the surface 512A of the accommodation member 512 and the surface 513A of the cover 513. Due to the location of the surface IA, maximum voltage VB obtained in response to ejection of ink toward the surface IA (shown in FIG. 7A) is lower than maximum voltage VB obtained in response to ejection of ink toward the surfaces 512A and 513A. Thus, the threshold value VT' is set to be lower than the threshold value VT. This configuration enables obtaining an appropriate result of inspection.

Other Embodiment

Another embodiment will be described below.

In the above embodiment, the voltage application circuit 61 applies positive voltage VA to the accommodation member 512 and the cover 513. In this other embodiment, as illustrated in FIG. 8A, the voltage application circuit 61 applies negative voltage VA to the accommodation member 512 and the cover 513.

Figure 8A:
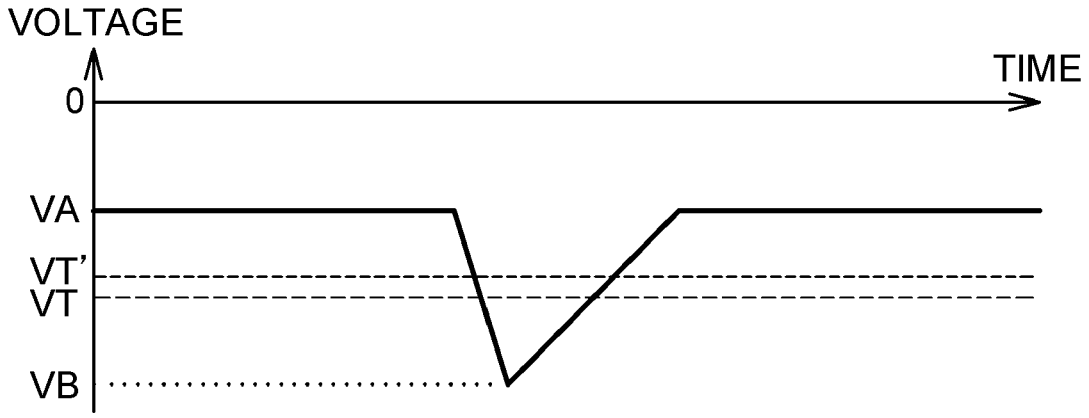
FIGS. 8A and 8B are each a diagram illustrating changes in voltage of the accommodating member and the cover in another illustrative embodiment.
Figure 8B:
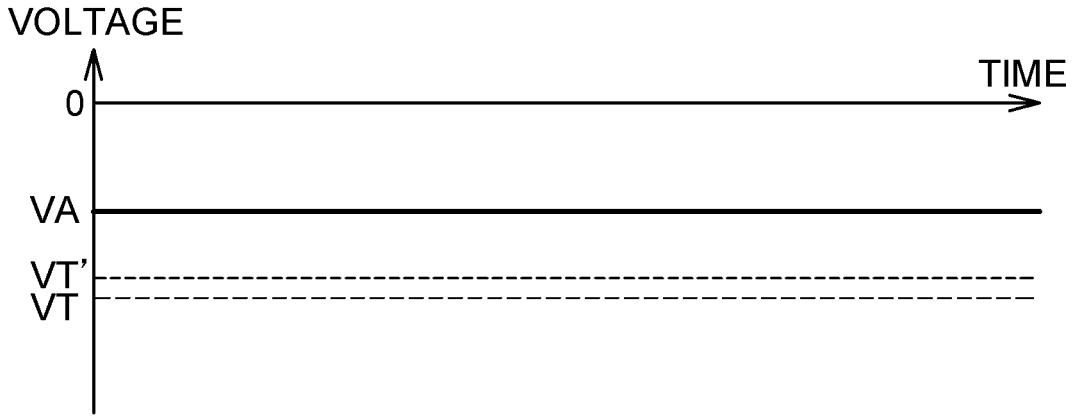

As illustrated in FIG. 8A, the voltage of each of the accommodation member 512 and the cover 513 decreases as the ejected ink approaches the accommodation member 512 and the cover 513. The decreasing voltage reaches a voltage VB less than the voltage VA when the ink reaches the accommodation member 512 and the cover 513. The voltage gradually increases after the ink reaches the accommodation member 512 and the cover 513 to the voltage VA. As illustrated in FIG. 8B, the voltage of each of the accommodation member 512 and the cover 513 is almost constant at the voltage VA while ink is not ejected from the nozzles 11N.

The ink I in the opening SA is also negatively charged at the voltage VA applied by the voltage application circuit 61 as the accommodation member 512 and the cover 513 are charged. Thus, the voltage of the ink I in the opening SA may change similarly as the voltage of the accommodation member 512 and the cover 513 change, as the ink is ejected from the nozzle 11N toward the opening SA.

In this other embodiment, the ASIC 94 determines that the nozzle 11N is not clogged (i.e., the ejecting condition of the nozzle 11N is normal) if the ASIC 94 finds that the voltage of the accommodation member 512 and the cover 513 fall below threshold value VT or VT' as illustrated in FIG. 8A.

The threshold value VT' is used for inspecting particular nozzles 11N through which ink is ejected toward the opening SA. The threshold value VT is used for inspecting other nozzles 11N through which ink is ejected toward the surface 512A of the accommodation member 512 and the surface 513A of the cover 513. The threshold value VT' is greater than the threshold value VT. The ink I in the opening SA functions as an electrode for inspection similarly as the accommodation member 512 and the cover 513 function as an electrode for inspection. The surface IA of the ink I in the opening SA is below the surface 512A of the accommodation member 512 and the surface 513A of the cover 513. Because the surface IA is below the surface 512A, the lowest voltage VB, shown in FIG. 8A, obtained in response to ejection of ink toward the surface IA is greater than the lowest voltage VB obtained in response to ejection of ink toward the surfaces 512A and 513A. Thus, the threshold value VT' is set to be greater than the threshold value VT. This configuration enables obtaining an appropriate result of inspection.

Modification

The above embodiments are merely examples. Various changes, arrangements and modifications may be applied therein without departing from the spirit and scope of the disclosure.

"Ejecting direction of ink" or "ejecting amount of ink", instead of "nozzle clogging", may be inspected as "the inspection of ejection condition of nozzle". The various processes based on the inspection result, which are not limited to "absorbing purge" or "flashing", may be performed.

The voltage detection circuit 62, instead of the controller 9, may compare the voltage of the accommodation member 512 and the cover 513 with the threshold value VT and VT', and output to the controller 9 a signal indicating the comparison result of the voltage of the accommodation member 512 and the cover 513.

The accommodation member 512 and the cover 513 may be at a ground potential, and a positive voltage or a negative voltage may be applied to the head 1. In this modification, the head 1, instead of the accommodation member 512 and the cover 513, may be connected to the voltage application circuit 61 electrically. This modification may use the voltage of the head 1 for the inspection.

At the inspection, ejected ink from the nozzle 11N may not necessarily reach the accommodation member 512 and the cover 513 as long as a potential difference is generated between the head 1 and both of the accommodation member 512 and the cover 513. In this modification, the ejected ink from the nozzle 11N may cause an induced current at the accommodation member 512 and the cover 513.

The potential difference may not necessarily be caused between the head 1 and both of the accommodation member 512 and the cover 513. The ejected ink from the nozzle 11N may be positively charged to some extent when the ink leaves from the nozzle surface 11A. The charged ink may cause increase of the voltage of the accommodation member 512 and the cover 513 as the ink approaches the accommodation member 512 and the cover 513. This change of voltage may allow the inspection.

The controller may include either of the CPU 91 or the ASIC 94 alone or in combination. The controller may include a plurality of CPUs and/or a plurality of ASICs.

The inclined surfaces 512Y and 513Y may, instead of being inclined, be curved.

Figure 9:
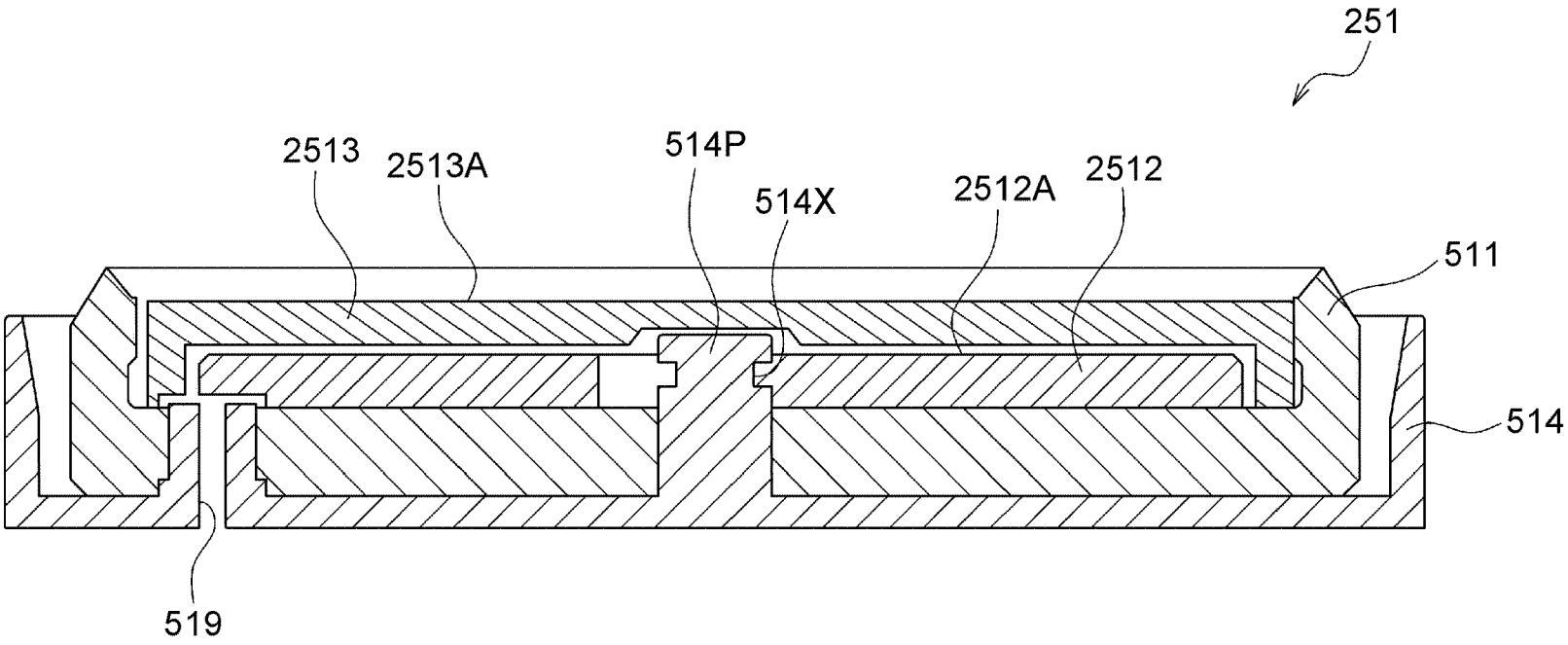
FIG. 9 is a sectional view taken along line IV-IV of FIG. 3 in a modification.

The accommodation member 512 may be fixed to the cap by the convex portion 514P having a swaged tip without the retaining ring 515. As illustrated in FIG. 9, the accommodation member 2512 may also be fed to the cap 511 by fitting the accommodation member 2512 to the groove 514X that is located adjacent to the tip of the convex portion 514P.

Without the cap holder 514 the accommodation member 2512 may be fixed to the cap 511. In this modification, the lower portion 511A may include a convex portion that passes through the accommodation member 2512, whereby the accommodation member 2512 is fixed to the cap 511.

The hook 513F may protrude from the side wall of the cover 2513 toward, instead of outside of the cover 2513, inside of the cover 2513. In this modification, the cavity of the accommodation member 2512 may be disposed at inside of the side wall of the cover 2513.

The cover 2513 may not necessarily fit the concave portion 512B of the accommodation member 2512. For example, an outer portion of the accommodation member 2512 that is located outside of the cover 2513 may be omitted. In this modification, the cover 2513 may be attached directly to the cap 2511 by the hook 513F of the cover 2513 fitting to the cavity of the cap 511. In this modification, as illustrated in FIG. 9, the cap device 251 has a surface 2512A not including a concave portion, and the cover 2513 is fixed directly to the cap 511. The accommodation member 2512 fits to the groove 514X formed adjacent to a tip of the convex portion 514P of the cap holder 514. The cover 2513 covers the convex portion 514P, and has a surface 2513*a* that is co-planar with the surface 2512*a* of the accommodation member 2512. The accommodation member 2512 covers the discharging outlet 519.

On the surface of the accommodation member 512 and/or the surface of the cover 513 may include one or more holes for draining reached ink.

The accommodation member 512 may include, instead of conductive resin, a porous material (absorber) such as a sponge.

Discharged liquid from the nozzle 11N may be, instead of ink, any liquid (e.g., a treatment liquid that aggregates or precipitates components in ink, a liquid in which metal particles are dispersed in a solvent).

The liquid ejection head may be a fixed line head from which liquid is ejected onto a liquid receiving medium, instead of a serial head that reciprocates.

The actuator may be, instead of a piezoelectric type using a piezoelectric element, another type (e.g., a thermal type using a heating element, an electrostatic type using electrostatic force).

The present invention may be applied to, instead of a printer, a facsimile machine, a copying machine, or a multifunction machine.

What is claimed is:

1. A cap device comprising:

a cap configured to cover a nozzle surface of a liquid ejection head, the nozzle surface including a plurality of nozzles each ejecting a droplet of liquid therefrom;

an accommodation member that is accommodated in the cap, the accommodation member having a conductivity and configured to receive a voltage that generates a potential difference between the liquid ejection head and the accommodation member, the accommodation member including a first portion and a second portion connected with each other, the accommodation member being fixed to the cap; and a cover configured to cover the second portion of the accommodation member, the cover having a conductivity and configured to receive a voltage that generates a potential difference between the liquid ejection head and the cover, wherein the first portion has a surface configured to face the nozzle surface, and wherein the cover has a surface configured to face the nozzle surface.

2. The cap device according to claim 1, wherein the cap device further comprises a protrusion, the protrusion passing through the accommodation member, and the protrusion extending toward the nozzle surface when the surface of the first portion in the accommodation member faces the nozzle surface, the protrusion fixing the accommodation member to the cap, and wherein the cover is configured to cover the protrusion.

3. The cap device according to claim 1, wherein the accommodation member has a concave portion, wherein a bottom of the concave portion corresponds to a surface of the accommodation member, and wherein the cover is fit for the concave portion.

4. The cap device according to claim 3, wherein a gap is located between the surface of the first portion in the accommodation member and the surface of the cover.

5. The cap device according to claim 4, wherein the gap has a width in a first direction and extends in a second direction along the bottom of the concave portion, the second direction being orthogonal to the first direction, and wherein a width of the gap in the first direction is greater than a distance between a pair of the nozzles in the plurality of nozzles.

6. The cap device according to claim 4, wherein at least one of the surface of the first portion in the accommodation member and the surface of the cover includes an inclined surface, and the inclined surface is angled outwardly.

7. The cap device according to claim 6, wherein the surface of the first portion in the accommodation member includes the inclined surface and the surface of the cover includes the inclined surface.

8. The cap device according to claim 4, wherein the accommodation member includes a cavity extending in a first direction, the cavity being separated from the concave portion by the cover, wherein the cover includes a hook configured to separate the cavity from the concave portion, wherein the hook and the gap overlap in a vertical direction, and wherein the hook is configured to define a bottom of the gap in the vertical direction.

9. The cap device according to claim 8, wherein the cover having a first width extending in the first direction and a second width extending in a second direction, the second direction being orthogonal to the first direction, and the second width being less than the first width, and wherein the hook is disposed at an end of the cover in the first direction.

10. The cap device according to claim 8, wherein the cap includes a discharging outlet at the bottom of the cap, the discharging outlet being for discharging ink in the cap, and wherein the hook and the discharging outlet do not overlap in the vertical direction.

11. The cap device according to claim 1, wherein the accommodation member includes a resin having a conductivity, wherein the cap includes a discharging outlet at a bottom of the cap, the discharging outlet being for discharging ink in the cap, and wherein the accommodation member covers the discharging outlet.

12. The cap device according to claim 1, wherein each of the accommodation member and the cover is electrically connected to a voltage application member that applies a voltage thereto.

13. A liquid ejection apparatus comprising:

a cap;

a liquid ejection head configured to move to a position where the liquid ejection head faces the cap, the liquid ejection head having a nozzle surface, the nozzle surface having a plurality of nozzles each ejecting a droplet of liquid therefrom;

an accommodation member that is accommodated in the cap, the accommodation member having a first surface and a second surface, the first surface facing the nozzle surface, the second surface facing the nozzle surface and being farther from the nozzle surface than the first surface, the accommodation member having a conductivity;

a protrusion protruding from the second surface of the accommodation member, the protrusion passing through the cap and the accommodation member, the protrusion fixing the accommodation member to the cap;

a cover configured to cover the protrusion, the cover having a surface, which is configured to face the nozzle surface, the cover having a conductivity;

a signal output member configured to output a signal indicating a potential difference between the liquid ejection head and at least one of the accommodation member and the cover; and a controller configured to:

cause a droplet to be ejected from each of the plurality of nozzles toward the accommodation member and the cover;

receive the signal from the signal output member; and determine an ejecting condition of the plurality of nozzles in accordance with the received signal.

14. The liquid ejection apparatus according to claim 13, wherein the accommodation member has a concave portion, a bottom of the concave portion corresponds to the second surface of the accommodation member, and wherein the cover is fit for the concave portion.

15. The liquid ejection apparatus according to claim 13, wherein a gap is located between the first surface of the accommodation member and the surface of the cover, wherein the controller determines that:

the ejecting condition does not have an error in a case where the potential difference is greater than a threshold value, and the ejecting condition has an error in a case where the potential difference is not more than the threshold value, and wherein the threshold value for a particular nozzle that ejects a droplet toward the gap is less than the threshold value for a nozzle other than the particular nozzle.

16. The liquid ejection apparatus according to claim 13, wherein a gap is located between the first surface of the accommodation member and the surface of the cover, wherein the controller determines that:

the ejecting condition does not have an error in a case where the potential difference is less than a threshold value, and the ejecting condition has an error in a case where the potential difference is not less than the threshold value, and wherein the threshold value for a particular nozzle that ejects a droplet toward the gap is greater than the threshold value for a nozzle other than the particular nozzle.

17. A cap device comprising:

a cap configured to cover a nozzle surface of a liquid ejection head, the nozzle surface including a plurality of nozzles each ejecting a droplet of liquid therefrom;

an accommodation member that is accommodated in the cap, the accommodation member having a conductivity and configured to receive a voltage that generates a potential difference between the liquid ejection head and the accommodation member;

a protrusion protruding from a surface of the accommodation member, the protrusion having a non-conductivity, the protrusion passing through the cap and the accommodation member, the protrusion fixing the accommodation member to the cap; and a cover configured to cover the protrusion, the cover having a conductivity and configured to receive a voltage that generates a potential difference between the liquid ejection head and the cover.

* * * * *